United States Patent [19]

McIntyre et al.

[11] Patent Number: 5,018,458

[45] Date of Patent: May 28, 1991

[54] FURNACE COMBUSTION ZONE TEMPERATURE CONTROL METHOD

[75] Inventors: Glover C. McIntyre, Pickering; Robert J. Lacombe, Saint John, both of Canada; Russell G. Forbess, Weston, Wis.

[73] Assignee: Zimpro Passavant Environmental Systems, Inc., Rothschild, Wis.

[21] Appl. No.: 581,338

[22] Filed: Sep. 12, 1990

[51] Int. Cl.[5] ..... F23G 5/00

[52] U.S. Cl. ..... 110/346; 110/190; 110/225; 110/245; 431/4; 431/190

[58] Field of Search ..... 110/188, 190, 225, 245; 431/190, 4, 33; 236/15 R; 432/38, 72

[56] References Cited

U.S. PATENT DOCUMENTS

| | | | |
|---|---|---|---|
| 3,958,920 | 5/1976 | Anderson | 432/23 |
| 4,046,085 | 9/1977 | Barry et al. | 110/12 |
| 4,056,068 | 11/1977 | Hafeli | 110/8 A |
| 4,060,041 | 11/1977 | Sowards | 110/8 F |
| 4,391,208 | 7/1983 | Lewis | 110/346 |
| 4,453,474 | 6/1984 | Lewis | 110/188 |
| 4,481,890 | 11/1984 | Lewis | 110/225 |
| 4,557,203 | 12/1985 | Mainord | 110/344 |
| 4,630,555 | 12/1986 | Guillaume et al. | 110/346 |
| 4,751,886 | 6/1988 | Koptis et al. | 110/190 |
| 4,759,298 | 7/1988 | Koptis et al. | 110/190 |

*Primary Examiner*—Edward G. Favors

*Attorney, Agent, or Firm*—Tipton L. Randall

[57] ABSTRACT

An improved method for controlling combustion zone temperature in a furnace independent of flue gas oxygen content is disclosed. The method comprises supplying a carrier gas containing a fine mist of liquid water droplets to the furnace combustion zone to control the maximum temperature within the combustion zone. The invention is applicable to both multiple hearth furnaces and fluidized bed furnaces, protecting the refractory furnace lining from damage.

17 Claims, 3 Drawing Sheets

FURNACE COMBUSTION ZONE TEMPERATURE CONTROL METHOD

FIELD OF THE INVENTION

This invention relates to a process for controlling the temperature in the combustion zone of a furnace, such as a multiple hearth furnace or a fluidized bed furnace, without forcing additional air through the furnace for cooling purposes.

DESCRIPTION OF RELATED ART

Numerous methods have been reported to control the temperature in the combustion zone of a furnace. Controlling the air supplied to the furnace is one option, while adding cooler gases or vapors can be employed. Water sprayers have also been used for cooling purposes.

In U.S. Pat. No. 4,046,085 Barry et al. show a multiple hearth furnace operated by separately supplying air to the respective hearths to add an oxidant, including water vapor or steam, to the fixed carbon zone to accelerate combustion.

U.S. Pat. No. 3,958,920 of Anderson shows a multiple hearth furnace in which relatively low temperature gases from the drying zone are recycled to the combustion zone to absorb excess heat. The method of this patent is known as the "Anderson Recycle" and functions by recycling 800° F. moisture-laden gases from the drying hearth back to the combustion hearth to control temperature. The fan used to recirculate such gases, however, has to handle 800° F. gases with entrained particulate material which is a very severe service.

Lewis, in U.S. Pat. Nos. 4,391,208, 4,453,474 and 4,481,890 discloses various temperature control methods for a furnace including supplying high velocity mixing jets as well as combustion air supply jets to the combustion hearths of a multiple hearth furnace.

In U.S. Pat. No. 4,557,203, Mainord discloses using multiple water sprayers within a reclamation furnace to control temperature.

Hafeli in U.S. Pat. No. 4,056,068 describes using a multiplicity of secondary air and water nozzles to add air and cooling water to a refuse incinerator to cool and condition flue gas to about 10% water vapor for efficient flue gas treatment.

In U.S. Pat. No. 4,630,555 Guillaume et al. disclose a water nozzle which uses oxygen to spray water into a batch operated incinerator. The liquid/gas mixture is aimed a specific distance above the material to be burned to assist incineration.

Sowards in U.S. Pat. No. 4,060,041 describes a fluidized bed incinerator system for solid wastes where downwardly flowing air impinges upon the upwardly fluidized bed medium.

SUMMARY OF THE INVENTION

An objective of the invention is to control combustion zone temperature in a furnace independent of flue gas oxygen content. That is, controlling furnace temperature without forcing additional air through the furnace for cooling purposes.

A further objective of the invention is to use the heat of vaporization of a fine mist of liquid water droplets within the combustion zone to control temperature therein.

A further objective of the invention is to position the liquid water mist generating means external to the combustion zone to prevent clogging of the mist generating means, and to introduce the fine water mist into the combustion zone of the furnace so as to prevent damage to the furnace refractory lining.

The invention is a method for controlling temperature in a combustion zone in a furnace, independent of flue gas oxygen content, comprising the steps:

(a) supplying combustion air to said furnace for combustion of a fuel therein;

(b) providing a plurality of low volume gas flow entry ports to said combustion zone in said furnace with carrier gas continuously flowing through said ports into said combustion zone;

(c) selecting a set point value for said combustion zone temperature which, upon said temperature exceeding said set point value, commences generation of a fine water mist external said combustion zone by mist generating means within said carrier gas, said mist flowing into said combustion zone with said carrier gas and reducing temperature within said combustion zone by vaporization therein; and (d) adding a proportionately greater amount of water mist to said carrier gas as the temperature of said combustion zone deviates above said set point value, said amount of water mist added limited by the capacity of said mist generating means, and ceasing said water mist generation upon said combustion zone temperature falling to or below said set point value.

The carrier gas is preferably air while the liquid water mist generating means may be a two-fluid atomizer or similar device.

In one embodiment the carrier gas and water mist are introduced into the combustion zone hearths of a multiple hearth furnace.

In another embodiment the carrier gas and water mist are introduced into the freeboard space of a fluidized bed furnace.

Other aspects, advantages and objects of the invention will become apparent to those skilled in the art upon reviewing the following detailed description, the drawings and appended claims.

DESCRIPTION OF THE PREFERRED EMBODIMENTS

Figure 1:
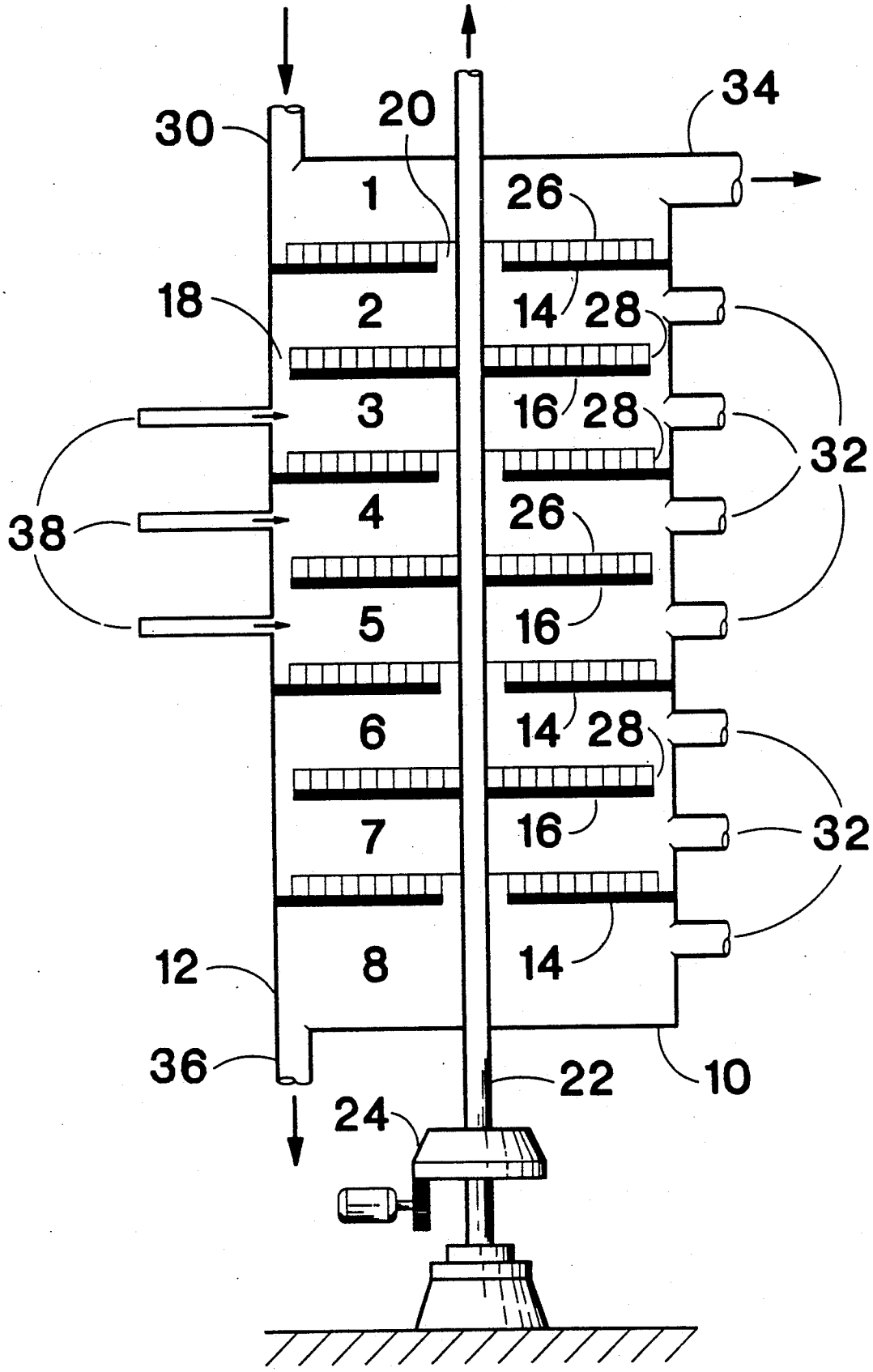
FIG. 1 is a schematic representation of a multiple hearth furnace employing the invention.

Referring to FIG. 1, a multiple hearth furnace 10 has a tubular outer shell 12 which is a steel shell lined with fire brick or other similar heat resistant material. The interior of the furnace 10 is divided by means of hearth floors 14 and 16 into a plurality of vertically aligned hearths, the number of hearths being preselected depending upon the particular waste material being incinerated. Each of the hearth floors is made of a refractory material and is slightly arched so as to be self supporting within the furnace. Outer peripheral drop holes 18 are provided near the outer shell at the outer periphery of the floors 16 and central drop holes 20 are provided near the center of hearth floors 14. A rotatable vertical center shaft 22 extends axially through the furnace 10 and is supported in appropriate bearing means at the top and bottom of the furnace. This center drive shaft 22 is rotatably driven by an electric motor and gear drive assembly generally indicated at 24. A plurality of spaced rabble arms 26 are mounted on the center shaft 22, and extend outwardly in each hearth over the hearth floor. The rabble arms have rabble teeth 28 formed thereon which extend downwardly nearly to the hearth floor. As the rabble arms 26 are carried around by the rotation of the center shaft 22, the rabble teeth 28 continuously rake through the material being processed on the respective hearth floors, and gradually urge the materials toward the respective drop holes 18 and 20.

The incineration of sewage sludge will be used to describe the invention. For purposes of discussion, the hearths are designated as 1 through 8 starting from the top of the furnace. The waste feed material to be processed enters the top of the furnace through inlet 30 onto the 1 hearth. In other situations the waste feed material may be fed to both the 1 and 2 hearths, or introduced through multiple feed inlets. Combustion air is supplied to each hearth through air inlets 32 and flue gas exits the furnace through an exhaust gas outlet 34. The flue gas exiting the furnace from sewage sludge incineration normally contains about 20 to 40% water vapor. The combustion air alternatively may be supplied to only a portion of the heaths or may be supplied totally to the bottom hearth, hearth 8, of the furnace. In this example sufficient air is supplied to the furnace for the stoichiometric oxidation or combustion of all the waste material within the furnace by the air inlets 32. In other situations it may be advantageous to use less than stoichiometric amounts of air for combustion. In those instances the furnace would be operating in a "starved air" or pyrolysis mode.

In the combustion of a wet material such as sewage sludge, the hearths 1 and 2 are termed the drying zone where the majority of the water is removed from the solids. As the sludge is passed downwardly through the furnace in a general serpentine fashion, i.e., alternately inward and outward across the hearths, the combustion gases from the various hearths flow upwardly, countercurrent to the downward flow of solid material. As oxidation of the solids commences, the temperature in hearths 3, 4 and 5 are the hottest, and these hearths are designated as the combustion zone of the multiple hearth furnace. The noncombustibles solids which remain are termed ash and the ash material continues down through hearths 6, 7 and 8 where cooling occurs. These last hearths are termed the ash cooling zone. The cooled ash exits the bottom of the furnace through an exit 36.

In the operation of a multiple hearth furnace for incinerating waste material, it is important to control the maximum temperature of operation to prevent damage to the rabble arms and teeth and the furnace refractory including the hearths. The center shaft 22 and rabble arms 26 are generally hollow which allows cooling air to pass through them, affording some degree of protection from high temperatures. Control of maximum temperature is particularly important in the incineration of thermally conditioned and dewatered sludge which is characterized by low moisture content, high volatile content, and high heating or calorific value. The maximum temperatures will thus occur in the combustion zone of the furnace. It may be possible to maintain a maximum temperature in the combustion zone by forcing additional air, much above stoichiometric requirements, through the furnace. This however requires additional energy and larger, more costly equipment and results in higher operating costs.

Applicants have found that temperature control can be achieved by providing a plurality of low volume gas flow entry ports 38 to the combustion zone with a carrier gas, air, continuously flowing into the combustion chamber. The carrier gas contains a fine water mist, from a mist generating means external the combustion zone, which absorbs heat upon entering the combustion zone by evaporation. The carrier air comprises only a small fraction of the total volume of combustion air supplied to the furnace. Details of the entry port, mist generating means and temperature control technique are described in FIG. 2.

Figure 2:
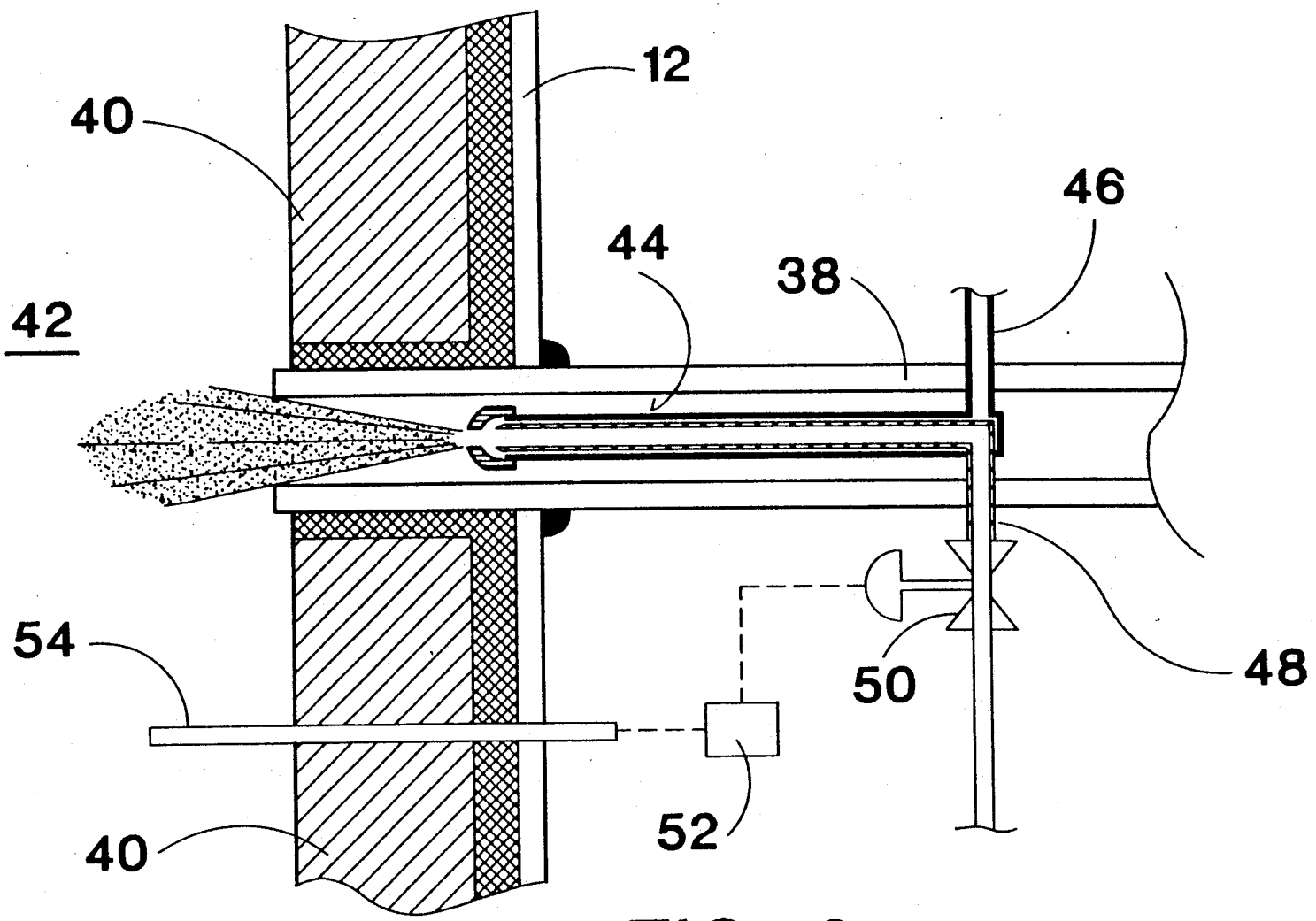
FIG. 2 is a detailed drawing of the low volume gas flow entry port and mist generating means of the invention.

Referring to FIG. 2, a low volume gas flow entry port 38 passes through the furnace outer shell 12 and the refractory/insulating lining 40. A low volume flow of air from an outside source (not shown) flows through the entry port 38 into the combustion zone 42, carrying with it a fine mist of liquid water droplets to absorb heat from the furnace. The carrier air volume is small compared to that of the combustion air. The water mist generating means 44 is a two-fluid atomizer, although other mist generating means, such as an ultrasonic vaporizer, may be used as long as a fine water mist is generated.

The atomizer is made up of an outer pressurized air delivery line 46 and an inner water supply line 48 with a control valve 50. The atomizer is designed to provide a very fine water droplet mist directed axially within the entry port 38.

The water supply valve 50 is operated by a controller 52 which is also connected to a temperature sensing probe 54 which monitors temperature in the combustion zone 42. As the temperature in the combustion zone rises above a preselected set point value, the controller 52 opens the water supply line valve 50 and commences generation of a fine water mist to reduce combustion zone temperature. Should the temperature in the combustion zone 42 increases further, controller 52 opens the valve 50 to a greater extent to provide additional water mist to reduce combustion zone temperature to the set point value. Design of the atomizer limits the amount of water mist capable of being applied to the combustion zone 42. The weight ratio of water mist to carrier air is a maximum of about 50:1, and preferably less than about 40:1. Typically the water mist to carrier air weight ratio is in the range of about 25:1 to 1:1 during normal furnace operation.

If for some reason the maximum water mist flow into the combustion zone 42 is insufficient to bring the temperature down to the set point value, other control means, such a ceasing addition of fuel to the furnace, come into effect. The method of the present invention provides a fine degree of temperature control (as opposed to a coarse degree) with respect to combustion zone temperature.

Further, the fine water mist droplet size prevents damage to the refractory which may be caused by a coarser water spray alone. Further, the placement of the mist generating means external the combustion zone coupled with the cooling flow of carrier air within entry port 38 prevents clogging of the atomizer by precipitated salts or particulate material.

Several entry ports are provided for temperature control of the combustion zone in a multiple hearth furnace. For the furnace of FIG. 1, each hearth, 3, 4 and 5, of the combustion zone has 2 to 4 cooling mist entry ports for precise temperature control. Each hearth has one temperature sensing probe 54 while a single controller 52 operates the water supply to all cooling mist entry ports for each hearth.

Figure 3:
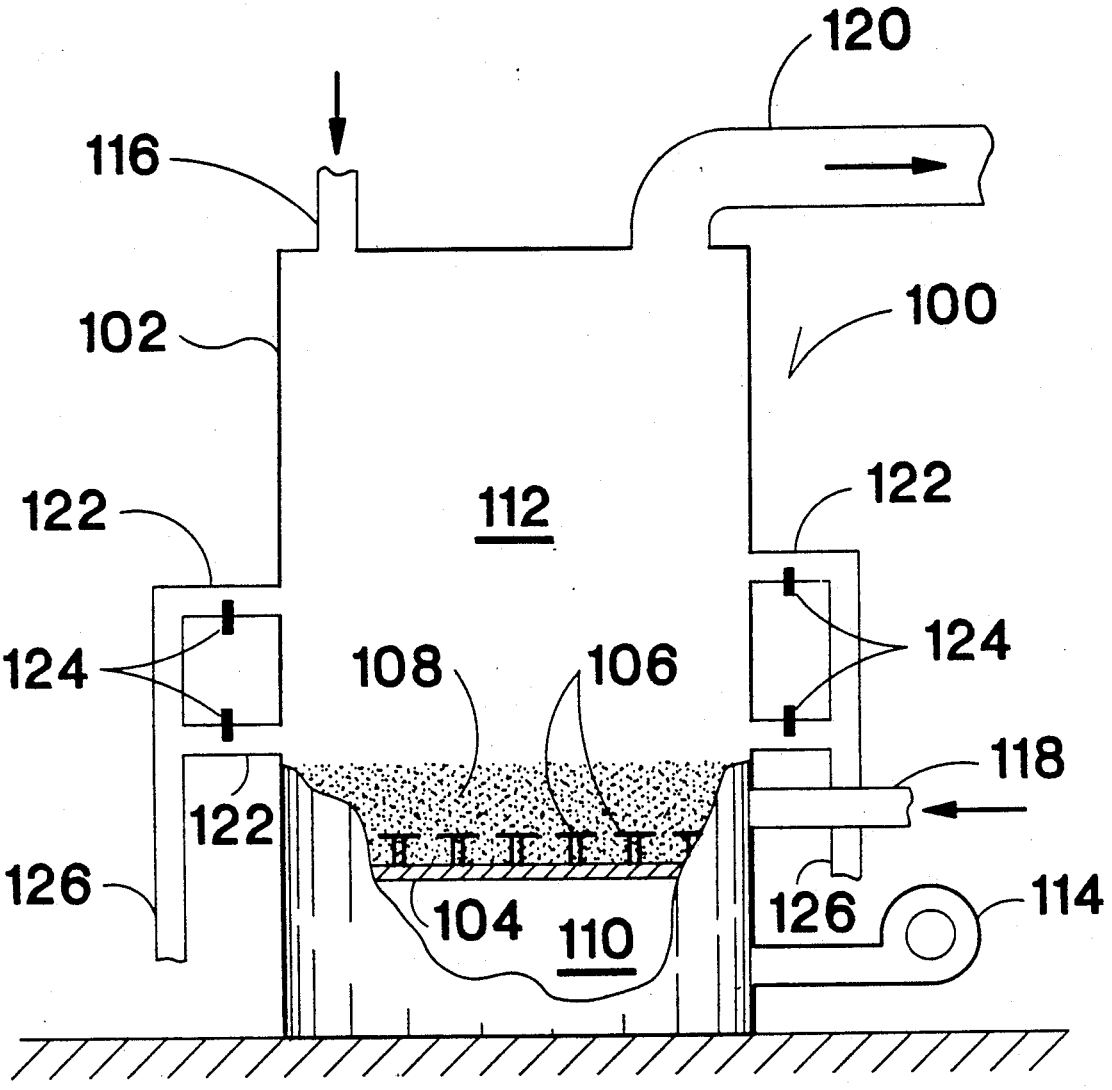
FIG. 3 is a schematic representation of a fluidized bed furnace employing the invention.

Referring to FIG. 3, a fluidized bed furnace 100 has a tubular outer shell 102 which is a steel shell lined with fire brick or other similar heat resistant material. The interior of the furnace is divided by a support 104 which supports the tuyeres 106 and the bed medium 108. The support 104 divides the interior of the furnace into a lower wind box 110 and an upper combustion zone composed of the fluidized bed 108 and the freeboard zone 112. Combustion air is supplied by a blower 114 which forces air into the wind box 110, upward through the tuyeres 106, fluidizing the bed 108 and combusting the waste material within the bed 108 and the freeboard zone 112. The fluidized bed 108 and the freeboard zone 112 thus constitute the combustion zone for the furnace. The waste material enters the furnace through an inlet 116 at the furnace top or alternatively through an inlet 118 below the surface of the fluidized bed medium 108. Exhaust gases exit the furnace through an exhaust gas outlet 120.

Low volume gas flow entry ports 122 continuously provide carrier gas to the freeboard zone 112. The carrier gas contains a fine water mist, from mist generating means 124 external the freeboard zone 112, which absorbs heat upon entering the freeboard zone by evaporation. Carrier gas is supplied through a conduit 126 from a source not shown. The entry ports 122, the mist generating means 124 and temperature control techniques are as described for FIG. 2.

We claim:

1. A method for controlling temperature in a combustion zone in a furnace, independent of flue gas oxygen content, comprising the steps:

(a) supplying combustion air to said furnace for combustion of a fuel therein;

(b) providing a plurality of low volume gas flow entry ports to said combustion zone in said furnace with carrier gas continuously flowing through said ports into said combustion zone;

(c) selecting a set point value for said combustion zone temperature which, upon said temperature exceeding said set point value, commences generation of a fine water mist external said combustion zone by mist generating means within said carrier gas, said mist flowing into said combustion zone with said carrier gas and reducing temperature within said combustion zone by vaporization therein; and (d) adding a proportionately greater amount of water mist to said carrier gas as the temperature of said combustion zone deviates above said set point value, said amount of water mist added limited by the capacity of said mist generating means, and ceasing said water mist generation upon said combustion zone temperature falling to or below said set point value.

2. A process according to claim 1 wherein less than a stoichiometric amount of combustion air is supplied to said furnace for fuel combustion.

3. A process according to claim 1 wherein more than a stoichiometric amount of combustion air is supplied to said furnace for fuel combustion.

4. A process according to claim 1 wherein said carrier gas is air.

5. A process according to claim 1 wherein said water mist and carrier gas flow to said combustion zone at a maximum weight ratio of about 50 parts water to 1 part air.

6. A process according to claim 1 wherein said water mist and carrier gas flow to said combustion zone at a maximum weight ratio of about 40 parts water to 1 part air.

7. A process according to claim 1 wherein said water mist and carrier gas flow to said combustion zone at a weight ratio of between about 25 parts water to 1 part air and about 1 part water to 1 part air.

8. A process according to claim 1 wherein said combustion zone is contained within a multiple hearth furnace.

9. A process according to claim 8 wherein said combustion air is supplied to the bottom of a multiple hearth furnace.

10. A process according to claim 8 wherein said combustion air is supplied to individual hearths of a multiple hearth furnace.

11. A process according to claim 8 wherein at least two low volume gas flow entry ports are provided for each hearth contained within said combustion zone.

12. A according to claim 8 wherein four low volume gas flow entry ports are provided for each hearth contained within said combustion zone.

13. A process according to claim 1 wherein said combustion zone is contained in a fluidized bed furnace.

14. A process according to claim 13 wherein said carrier gas entry ports are located in the freeboard area of a fluidized bed furnace.

15. A process according to claim 13 wherein four low volume gas flow entry ports are provided in the freeboard area of a fluidized bed furnace.

16. A process according to claim 1 wherein said mist generating means is a two-fluid atomizer.

17. A process according to claim 1 wherein said mist generating means is an ultrasonic vaporizing device.

* * * * *